US005721999A

United States Patent [19]

Calisto et al.

[11] Patent Number: 5,721,999

[45] Date of Patent: Feb. 24, 1998

[54] METHOD AND APPARATUS FOR PROCESSING PHOTOSENSITIVE MATERIAL

[75] Inventors: Edward Andrew Calisto, Hockessin, Del.; Daniel Frederick Juers, Fairport, N.Y.; John George Van Remoortel, Newark, Del.

[73] Assignee: E. I. du Pont de Nemours and Company, Wilmington, Del.

[21] Appl. No.: 703,915

[22] Filed: Aug. 22, 1996

Related U.S. Application Data

[62] Division of Ser. No. 421,119, Apr. 13, 1995, Pat. No. 5,579,076.

[51] Int. Cl.[6] ..... G03D 3/02

[52] U.S. Cl. ..... 396/627; 396/631

[58] Field of Search ..... 396/612, 620, 396/622, 626, 630, 631, 627, 636

[56] References Cited

U.S. PATENT DOCUMENTS

| | | | |
|---|---|---|---|
| 4,142,194 | 2/1979 | Hamlin | 354/318 |
| 4,334,758 | 6/1982 | Leveille | 396/616 |
| 4,641,941 | 2/1987 | Yoshimi | 354/324 |
| 4,719,173 | 1/1988 | Hahm | 430/398 |
| 4,800,408 | 1/1989 | Yamada | 354/322 |
| 4,853,727 | 8/1989 | Ganzke et al. | 354/319 |
| 4,987,438 | 1/1991 | Goto et al. | 396/612 |
| 4,995,913 | 2/1991 | Juers | 134/13 |
| 5,019,850 | 5/1991 | Ishikawa et al. | 354/322 |
| 5,040,013 | 8/1991 | Kurokawa et al. | 354/322 |
| 5,053,796 | 10/1991 | Ohba | 396/630 |
| 5,059,996 | 10/1991 | Bailey et al. | 396/627 |
| 5,070,351 | 12/1991 | Vanover et al. | 354/299 |
| 5,168,296 | 12/1992 | Nakamura et al. | 354/320 |
| 5,168,297 | 12/1992 | Wernicke | 354/324 |
| 5,177,522 | 1/1993 | Hayashi | 396/627 |
| 5,194,095 | 3/1993 | Yates | 134/10 |
| 5,272,499 | 12/1993 | Yamada | 354/319 |

*Primary Examiner*—D. Rutledge

[57] ABSTRACT

An apparatus for washing a web or sheet of photosensitive material during the development process by passing the material through a series of stations where the washing is accomplished by spraying and the material is not immersed into a wash bath and the washed material consistently meets archival quality and a process for washing the material using the apparatus.

4 Claims, 8 Drawing Sheets

METHOD AND APPARATUS FOR PROCESSING PHOTOSENSITIVE MATERIAL

This is a division of application Ser. No. 08/421,119, filed Apr. 13, 1995, now U.S. Pat. No. 5,579,076.

BACKGROUND OF THE INVENTION

1. Field of the Invention

This invention relates to a method and apparatus for processing a photosensitive material and specifically for washing photographic material.

2. Description of the Related Art

Processing of silver halide films as used in this application comprises subjecting silver halide film sheets or webs to development, fixing and washing stages. The film typically, but not necessarily, carries a latent image thereon which is rendered visible and permanent as a result thereof.

Equipment to facilitate and speed the processing is widely available in the art. Such equipment typically comprises a series of tanks or similar stations through which the film is passed sequentially. Each station contains either a developer chemical, a fixer chemical or water for washing the chemicals off the surfaces of the film once the desired chemical's effect on the film has been achieved.

The developer or fixer chemicals can be used in small quantities, in concentrated form and appropriately replenished, thus permitting their handling without the need for substantial equipment, if any, external to the apparatus plumbing. The wash stages on the other hand, heretofore have typically required a substantial amount of fresh water flow and associated plumbing to supply the fresh water as well as to provide an outlet for the wash water after it has been used to wash the film.

In order to minimize the amount of fresh water used in the wash stages of a processor, it is known to use multiple wash stages employing either a counter current fluid flow, or a concurrent fluid flow, as described in U.S. Pat. No. 4,719,173. One way to obtain this counter current or concurrent fluid flow is through the use of overflow tanks of the type disclosed in U.S. Pat. No. 4,641,941.

Regardless of the teachings of U.S. Pat. No. 4,719,173 and whether counter current or concurrent flow is employed, a substantial amount of wash water is still used because in an effort to obtain complete washing of the film, an excess of water flow is provided. It is, of course, well known in the film-developing art that the existence of residual chemicals on processed film, particularly thiosulfate, eventually results in undesirable film staining or image degradation. Yet, the obvious solution of using ample water to wash the film is becoming increasingly impractical because of the need to properly dispose of water contaminated with the chemicals washed from the film.

Many methods are available to handle the wash water problem. One method used is on-line recirculating electrolysis (ORE) of the fixer This approach, available from both film manufacturers and equipment vendors, is primarily intended to recover silver from the fixer. However, reducing silver in the fixer also reduces the amount of silver carried from the fixer into the wash water and, as such, waste wash water quality is also improved. This method suffers from relatively high initial investment, complex operation, and high silver level in the wash water during peak film processing periods.

A lower cost option in terms of initial investment is a simple wash water recirculator that does nothing to treat the wash water. This type of simple circulator results in serious film quality problems even after only small quantities of film have been processed.

Another option available from both film manufacturers and equipment vendors is a wash water recirculating unit that treats the recirculating water and reuses all or a large fraction of the wash water. However, these units use ion exchange technology. Such units are usually effective, but they do require regular, routine maintenance or they will become ineffective. This maintenance is not only inconvenient for the user, but adds additional operating costs per unit. Since one unit is needed for each processor, annual operating costs can be quite high for a large shop.

Other technologies have been proposed and tested for treating wash water, but these have all proved either too expensive or too unreliable technically. In this category are evaporation, ozone treatment, iodine treatment, and potassium iodide precipitation.

Thus, there is a strong need to minimize the amount of wash water used in silver halide film processors, and for a method or apparatus to avoid using any excess water over what is necessary to produce complete washing of the film and at the same time minimize the amount of waste water discharged into public sewer systems.

SUMMARY OF THE INVENTION

In accordance with this invention, there is provided an apparatus for processing a web or sheet of photographic material comprising:

a plurality of wash stations including a first and a last station, each of the wash stations comprising:

- a first spray bar for spraying washing solution on a top surface of the sheet,
- a second spray bar for spraying washing solution on a bottom surface of the sheet,
- a first pair of rollers defining a nip positioned at a first level to feed the sheet between the first spray bar and the second spray bar,
- a second pair of rollers defining a nip positioned at a second level lower than the first level to receive the sheet from the first and second spray bars and to feed the sheet to an adjacent wash station which if there are only two wash stations is the last station or a non-wash station,
- a container for receiving washing solution from the first and second spray bars, and means for providing washing solution to the spray bars;

means for flowing washing solution through the containers in a counter current arrangement to the direction of material transport; and means for rotating the rollers to transport the sheet through the wash stations in order from the first station and ultimately through the last station.

BRIEF DESCRIPTION OF THE DRAWINGS

The invention can be more fully understood from the following detailed description in connection with the accompanying drawings in which.

DETAILED DESCRIPTION OF THE PREFERRED EMBODIMENT

Figure 1:
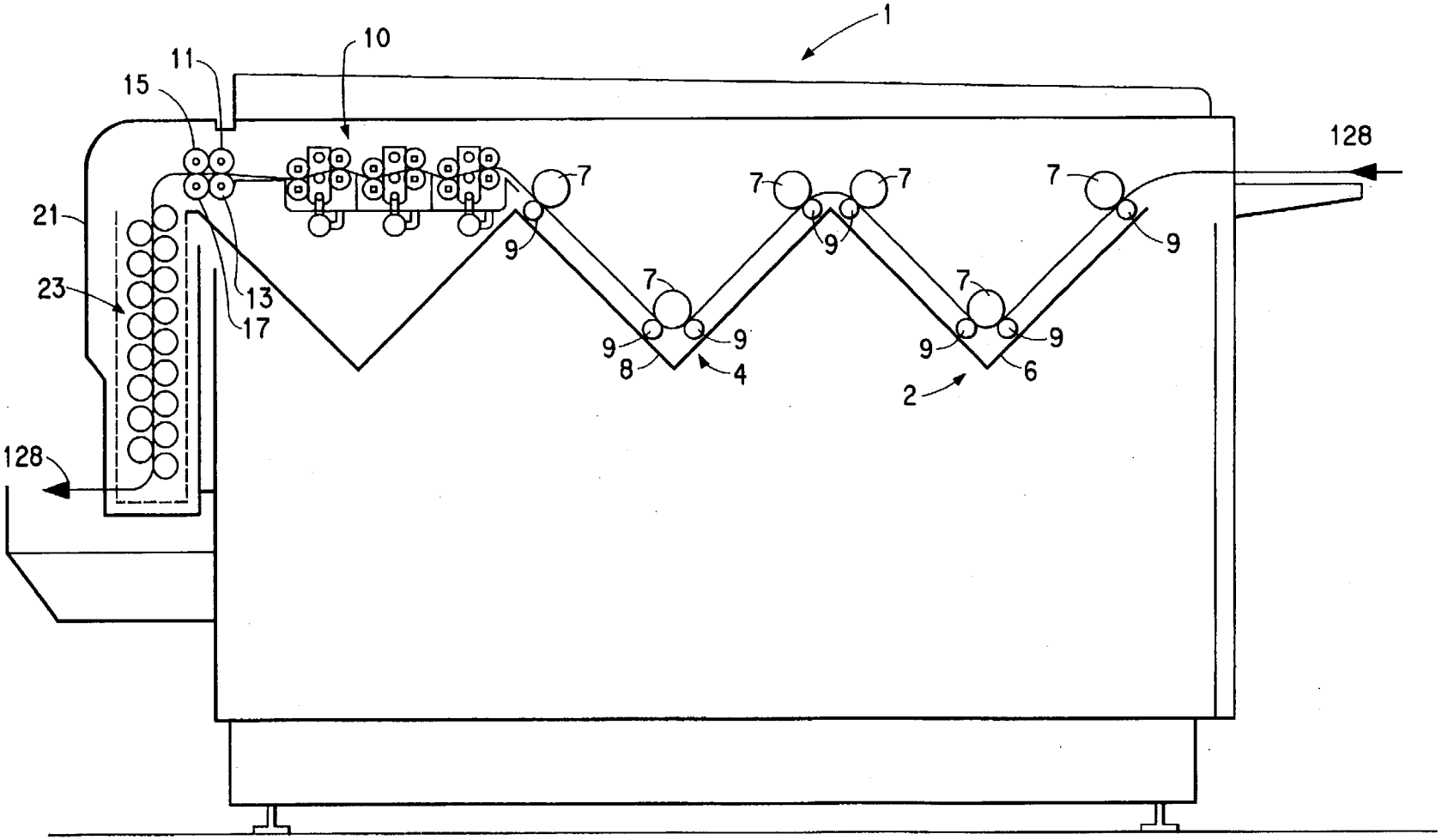
FIG. 1 is a schematic cross-sectional side view of an apparatus showing a wash unit in accordance with the present invention.

Throughout the following detailed description, similar reference numerals refer to similar elements in all Figures of the drawings.

Referring to FIG. 1 there is illustrated an apparatus 1 for processing material in accordance with the present invention. The apparatus 1 is for processing a web or sheet of a photographic material by developing, fixing and washing the sheet. This invention is further directed to a method for processing a sheet or web of photographic material using the apparatus 1.

A developer station 2 comprises a developer tank 6 which is a first means for holding process developer solution. A fixer station 4 comprises a fixer tank 8 which is a second means for holding process fixer solution. The developer station 2 and the fixer station 4 comprise upper rollers 7 and lower rollers 9 disposed between parallel side walls, not depicted, of apparatus 1. Referring to FIG. 1, the upper rollers 7 and the lower rollers 9 are means for transporting the sheet through the process developer solution when the process developer solution is in the developer tank 4 and transporting the sheet through the fixer developer solution when the fixer developer solution is in the fixer tank 8. The rollers 7,9 are driven by a drive shaft 300 of the apparatus 1 depicted in FIG. 6 and more fully described below. The sheet is transported within the apparatus 1 in the direction of arrow 128 as shown in FIG. 1.

Figure 2:
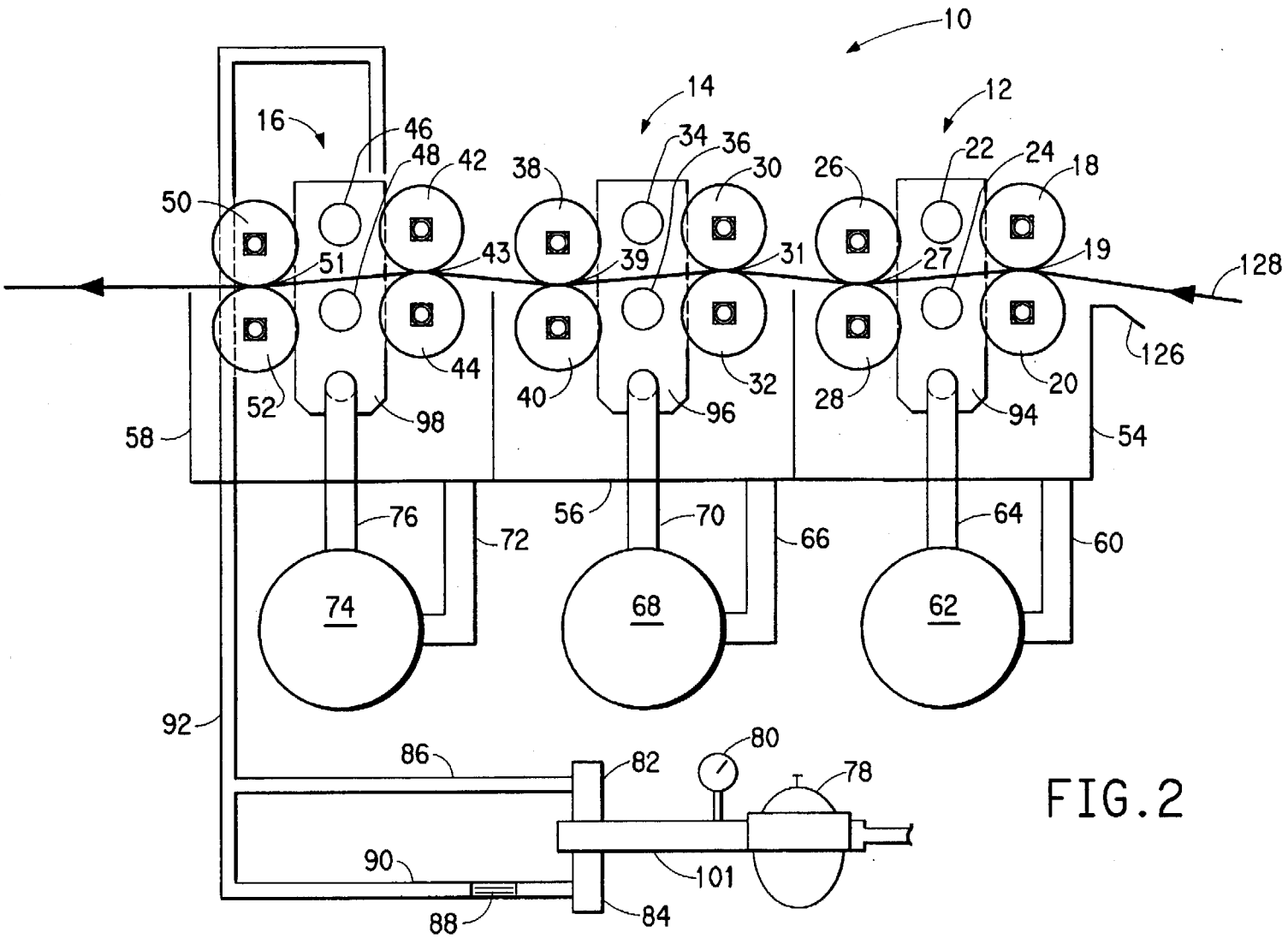
FIG. 2 is a schematic cross-sectional side view of the wash unit.

As depicted in FIG. 2, the apparatus 1 comprises a plurality of wash stations 12,14,16 including a first wash station 12, a second wash station 14 and a last wash station 16 which further comprise a single wash unit 10. The rollers 7,9 in FIG. 1 are means for transporting the sheet into a nip 19 of a first pair of rollers 18,20 of the wash station 12. The wash station 12 comprises a first spray bar 22 for spraying water on a top surface of the sheet and a second spray bar 24 for spraying water on a bottom surface of the sheet. The sheet can be washed with any suitable medium, however, the washing solution is typically water. The wash station 12 comprises the first pair of rollers 18,20 defining the nip 19 positioned at a first level to feed the sheet between the first spray bar 22 and the second spray bar 24. The wash station 12 comprises a second pair of rollers 26,28 defining a nip 27 positioned at a second level lower than the first level of the nip 19 to receive the sheet from between the first and second spray bars 22,24. The second pair of rollers 26,28 feed the sheet to the wash station 14. Wash station 12 comprises a first container 54 for receiving the water from the first and second spray bars, 22,24. At wash station 12, means for recirculating water from the container 54 through the first and second spray bars 22,24 is provided comprising a pump 62 which receives water from the container 54 through an outlet 60. The water is then provided from the container 54 by the pump 62 through a conduit 64 to a manifold 94. Water is distributed from the manifold 94 to the spray bars 22,24.

In FIG. 2 the wash station 14 comprises a first spray bar 34 for spraying washing solution on the top surface of the sheet and a second spray bar 36 for spraying washing solution on the bottom surface of the sheet. The wash station 14 comprises a first pair of rollers 30,32 defining a nip 31 positioned at a first level to feed the sheet between the first spray bar 34 and the second spray bar 36. The nip 27 of the second pair of rollers 26,28 of the wash station 12 is positioned lower than the nip 31 of the first pair of rollers 30,32 of the wash station 14. The wash station 14 comprises a second pair of rollers 38,40 defining a nip 39 positioned at a second level lower than the first level of the nip 31 to receive the sheet from between the first and second spray bars 34,36. The second pair of rollers 38,40 feed the sheet to the last wash station 16. Wash station 14 comprises a second container 56 for receiving the washing solution from the first and second spray bars 34,36. At wash station 14, means for recirculating water from the second container 56 is provided comprising a pump 68 which receives water from the container 56 through an outlet 66. The water is provided from the container 56 by the pump 68 through a conduit 70 to manifold 96. Water is distributed from the manifold 96 to the spray bars 34,36.

In FIG. 2 the wash station 16 comprises a first spray bar 46 for spraying washing solution on the top surface of the sheet and a second spray bar 48 for spraying washing solution on the bottom surface of the sheet. The wash station 16 comprises a first pair of rollers 42,44 defining a nip 43 positioned at a first level to feed the sheet between the first spray bar 46 and the second spray bar 48. The nip 39 of the second pair of rollers 38,40 of the wash station 14 is positioned lower than the nip 43 of the first pair of rollers 42,44 of the wash station 16. The wash station 16 comprises a second pair of rollers 50,52 defining a nip 51 positioned at a second level lower than the first level of the nip 43 to receive the sheet from between the first and second spray bars 46,48. The second pair of rollers 50,52 feed the sheet at an angle to a non-wash station which is a pair of squeegee rollers 11,13 as shown in FIG. 1 and located at a higher level than the nip 51 of rollers 50,52. Wash station 16 comprises a third container 58 for receiving the washing solution from the first and second spray bars, 46,48. At wash station 16, means for recirculating water from the container 58 is provided comprising a pump 74 which receives water from the container 58 through an outlet 72. The water is provided from the container 58 by the pump 74 through a conduit 76 to manifold 98. Water is distributed from the manifold 98 to the spray bars 46,48.

The spray bars 22,24,34,36,46,48 each has a plurality of holes (not shown) aligned along their lengths that allow the water to spray on the top and bottom surfaces of the sheet. The number and size of the holes can vary according to the type or size of photographic material processor used. For the embodiments described herein, the holes in the bottom spray bars 24,36,48 are larger than the holes in the top spray bars 22,34,46.

Means for providing water to the spray bars 22,24,34,36, 46,48 of wash stations 12,14,16 is depicted in FIG. 2. The water is initially provided from a source not shown through a conduit 101. The source can be a public water supply or some other source. The water is provided to the container 58 in either a fill mode as when the processing unit is being started up or in a replenishment mode during processing. Because the water source could have a higher pressure than desired, a pressure regulator 78 can be used in line with the conduit 101 to maintain the pressure at an acceptable level. There can also be a gauge 80 for monitoring the pressure. A solenoid 82 would typically provide for rapid water flow through a fill tube 86 as when filling the container 58 for initial start-up or upon re-start after draining of the apparatus 1. Means for supplying replenishment water at a rate less than 20 milliliters per square foot (215 milliliters per square meter) of material being processed is provided by a solenoid 84. The solenoid 84 would provide the desired lower rate of flow relative to the solenoid 82 used for the fill mode because the solenoid 84 has a smaller internal opening, not shown, that restricts the water flow to the desired rate. An alternate embodiment as depicted in FIG. 2 is the solenoid 84 in combination with an orifice 88. The orifice 88 can be set in a replenish tube 90 and can be selected for size to provide different rates of water flow less than 20 milliliters per square foot (215 milliliters per square meter) of material being processed in the replenishment mode. In the replenishment mode, the supplying replenishment means is the only means for supplying replenishment water to the container 58 through the replenish tube 90 into a supply tube 92 which feeds the water into the container 58. Also, in the fill mode, water is supplied through the fill tube 86 and then into the supply tube 92 and only to the container 58.

Figure 3:
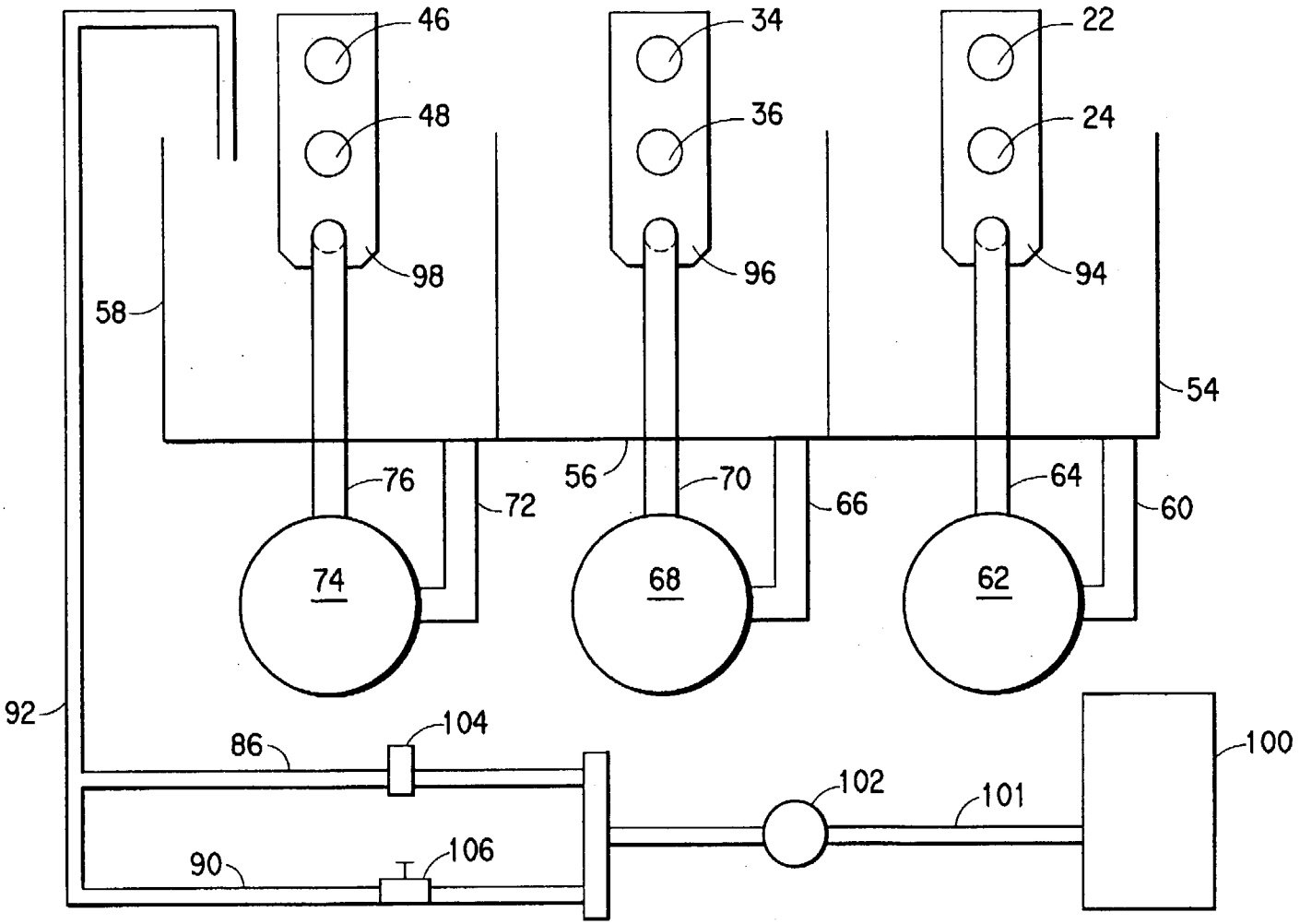
FIG. 3 is a schematic illustration showing a water tank as a source of wash water with a needle valve for controlling replenishment and a solenoid for filling.

FIG. 3 depicts another embodiment wherein water is initially supplied from a water tank 100 through the conduit 101 by a pump 102 and the flow of the water is controlled through a solenoid 104 in line with the fill tube 86 in the fill mode. In this embodiment means for supplying replenishment water is through a needle valve 106 in line with the replenish tube 90. The needle valve 106 provides for a water replenishment rate less than 20 milliliters per square foot (215 milliliters per square meter) of material being processed. The water tank 100 can be used when preferred or when a public water supply is not available. A biocide can be placed in the water tank 100 to prevent the formation of algae and the like.

Figure 4:
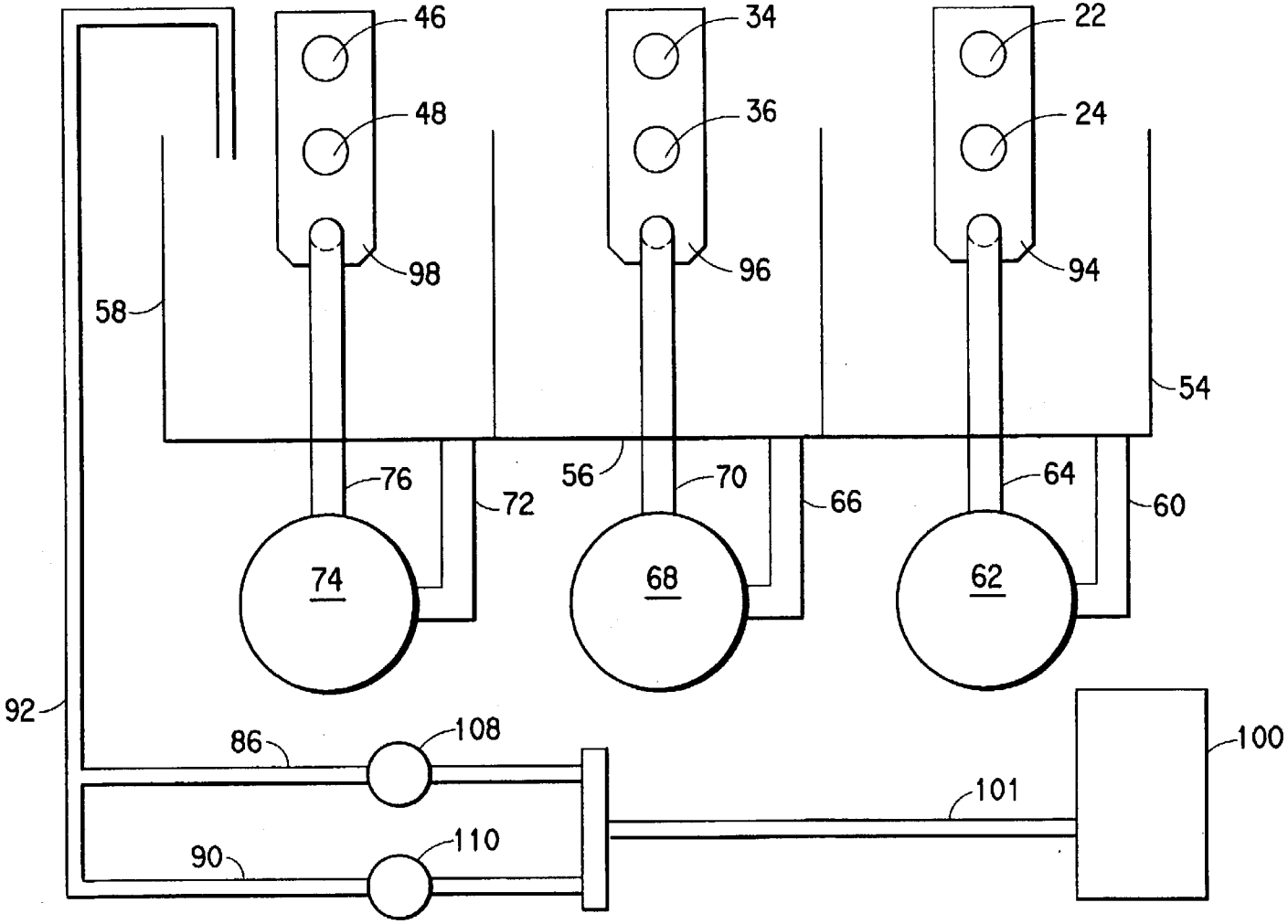
FIG. 4 is a schematic illustration showing a water tank as a source of wash water and separate pumps for filling and for replenishing.

Yet another embodiment of the water supply is depicted in FIG. 4, where the fill tube 86 has an individual pump 108. Means for supplying replenishment water at rate less than 20 milliliters per square foot (215 milliliters per square meter) of material being processed is an individual metering pump 110 in line with the replenish tube 90. A biocide can be placed in the water tank 100 to prevent the formation of algae and the like.

Figure 6:
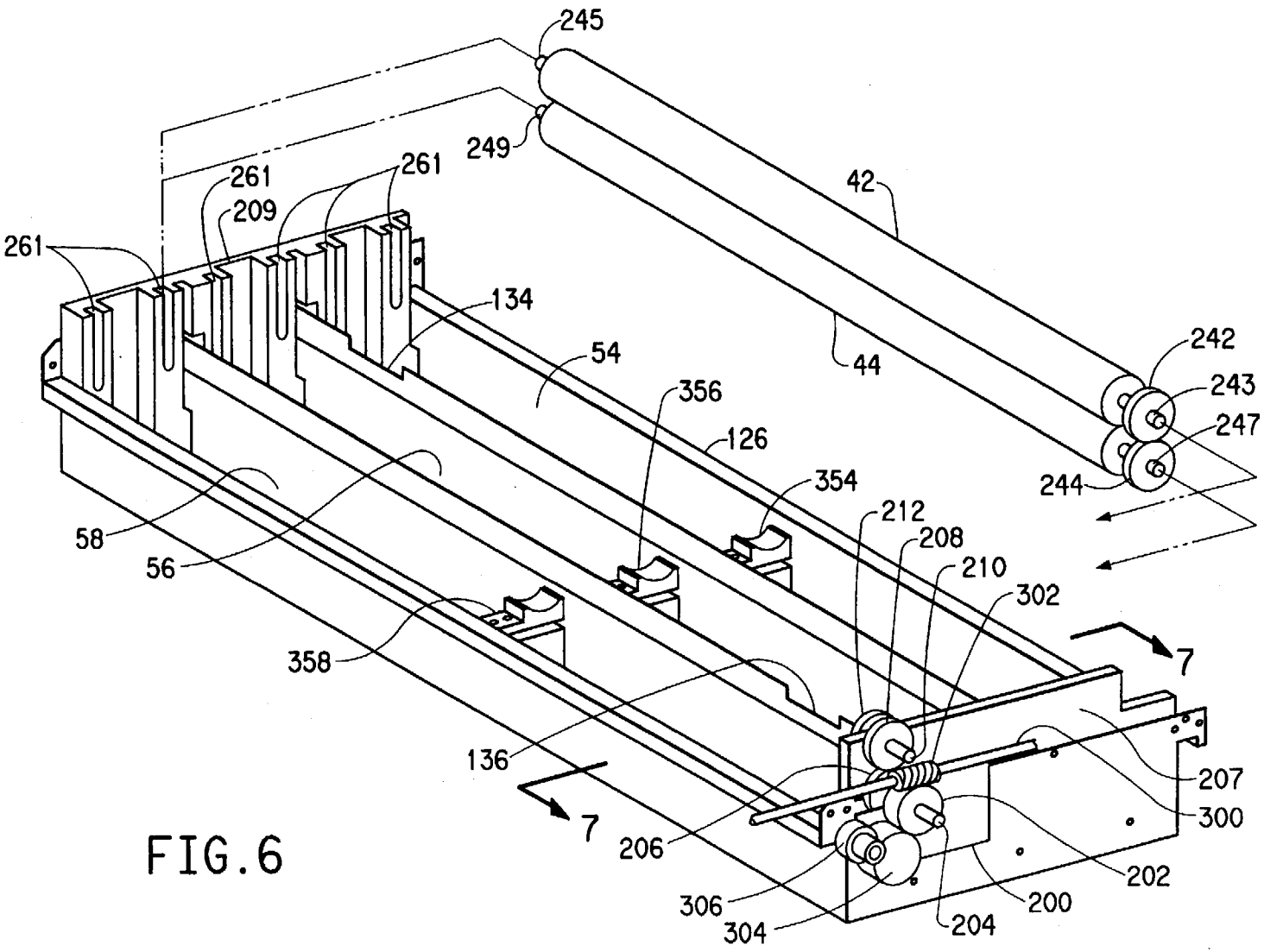
FIG. 6 is an isometric view of the wash unit showing means for rotating rollers from a drive shaft of the apparatus.

Means for flowing the water through the containers 54,56,58 in a counter current arrangement (that is, opposite to the sheet transport direction as indicated by the arrow 128) can be understood from FIG. 2 and FIG. 6. In both the fill mode and replenishment mode, the water is supplied only into the container 58. The water from the container 58 flows in a counter current fashion into the container 56 and then into the container 54. Weirs 134,136, as shown in FIG. 6, provide for the counter current flow of the wash water sequentially from the container 58 through weir 136 to the container 56 and through the weir 134 to the container 54. The container 54 does not have a weir, therefore the wash water flows over the lip 126 into the fixer tank 8.

Figure 5:
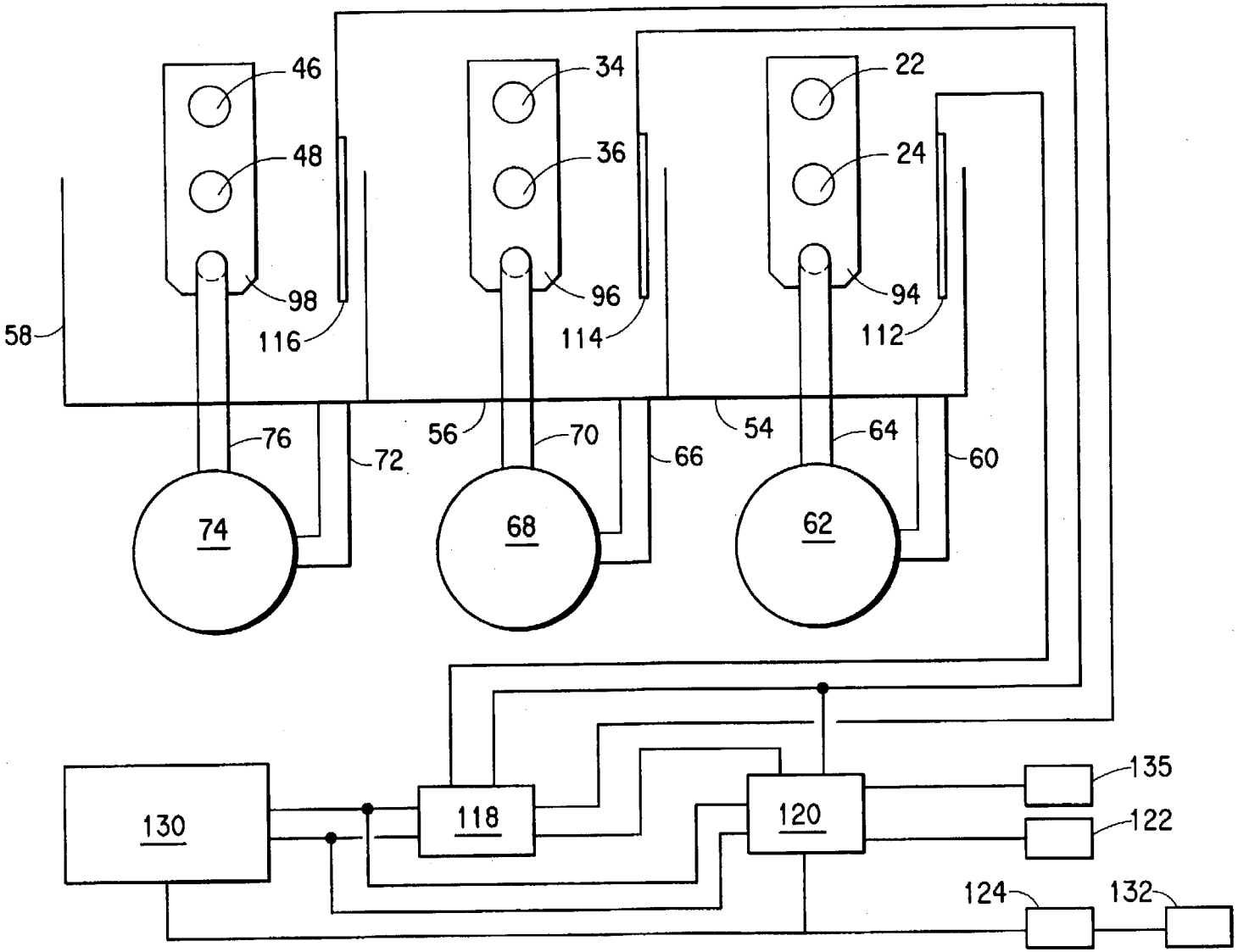
FIG. 5 is a schematic illustration showing sensors and associated controls for maintaining bath levels.

Depicted in FIG. 5 are means for sensing and controlling the level of water and controlling the fill and/or replenishment modes to the container 58. Level sensors 112,114,116 detect water levels and level controllers 118,120 place the system in either a fill mode or wash mode as required. If the water level is lower than desired, controllers 118,120 switch solenoid 135 open to fill the containers 54,56,58. If the water level is satisfactory, controllers 118,120 switch to a wash relay 122. When the sheet is introduced into the apparatus 1, a wash signal activates the wash relay 122, thereby allowing the pumps 62,68,74 to run. The wash relay 122 also prevents damage to the pumps 62,68,74 by preventing them from running when the water level in the containers 54,56,58 is too low. When a fixer replenishment signal is received from the apparatus 1, a replenishment relay 124 closes and switches a solenoid 132 open to allow water replenishment. This arrangement for sensing and controlling the water level is only one method and it is recognized that there can be other arrangements.

Figure 7:
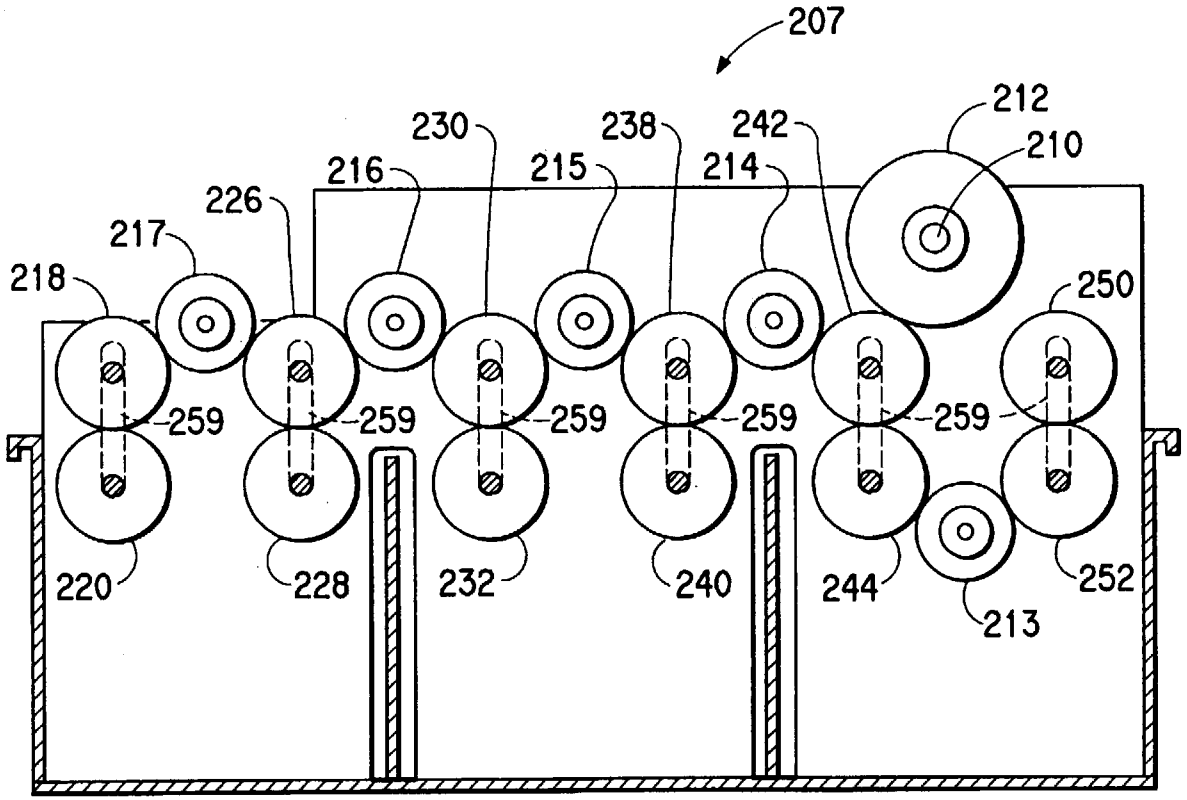
FIG. 7 is a simplified schematic illustration viewed generally on the line 7—7 in FIG. 6 in the direction of the arrows showing means for driving rollers of the wash unit.

Depicted in FIGS. 6 and 7 are means for rotating the rollers 18,20,26,28,30,32,38,40,42,44,50,52 to transport the sheet in order from the first wash station 12, to the second wash station 14, and ultimately through the last wash station 16. FIG. 6 shows gears 202,206,304,306 rotatably mounted on plate 200 and located so that the drive shaft 300 can be used to rotate the roller pairs 18,20,26,28,30,32,38,40, 42,44,50,52. The drive shaft 300 is only depicted in part in FIG. 6, however it would extend substantially the length of the apparatus 1 and also drives the rollers 7,9 in FIG. 1 through gears not shown. The plate 200 is attached by means (not shown) to a wall (not shown) of the apparatus 1. As depicted in FIG. 6 the apparatus 1 comprises a bearing block 207 which has gears 208,212 rotatably mounted thereon. FIG. 7 depicts other gears 213,214,215,216,217 rotatably mounted on the bearing block 207 as further described below.

The drive shaft 300 has a worm gear 302 that rotates the gear 202. The gear 202 connects with the gear 206 through a shaft 204. The gear 206 engages the gear 208 mounted on the bearing block 207. The gear 208 connects to the gear 212 through a shaft 210. FIG. 6 depicts the arrangement of the roller pairs in the apparatus 1 using the roller pair 42,44 of the wash station 16 as an example wherein the roller pair 42,44 has gears 242,244 and stems 243,247 at one of the ends and stems 245,249 at opposite ends, respectively. FIG. 6 along with FIG. 7 further depict the arrangement of the roller pairs in the apparatus 1 by example of the roller pair 42,44 wherein the stems 243,247 fit into a slot 259 in the bearing block 207 and the stems 245,249 fit into a slot 261 in a bearing block 209. As shown in FIG. 7, the gear 212 engages the gear 242 and thereby rotates the roller 42 (not shown). The gear 242 of the roller 42 engages the gear 244 of the roller 44 and thereby rotates the roller 44 (not shown). As with the roller pair 42,44, all of the other roller pairs have a gear at one end and stems at both ends which fit into the slots 259 and 261. FIG. 7 shows how the roller pairs of apparatus 1 (not shown) are rotated by engagement of gears 218,220,226,228,230,232,238,240, 242,244,250,252 at the ends of the rollers with the gears 212,213,214,215,216,217 mounted on the bearing block 207.

The gear 202 as depicted in FIG. 6 also engages a gear 304 which in turn engages a gear 306. The gear 306 engages a gear (not shown) on an end of the squeegee roller 13 shown in FIG. 1 and thereby drives the squeegee roller 13.

The arrangement of the gears as depicted in FIGS. 6 and 7 is only one example of how to rotate the roller pairs of the apparatus 1. Other embodiments would be used depending on the type of drive mechanism of an apparatus into which the wash unit 10 would be incorporated.

Also depicted in FIG. 6 are center supports 354,356,358 located within containers 54,56,58 to provide support to the first and second roller pairs of each wash station 12,14,16. For example, the roller pair 42,44 as depicted in FIG. 6 would be supported by the concave area on center support 358. In order to maintain the nips at the desired tight clearance needed to transport the sheet, it is generally required to support the rollers to prevent sagging in relatively wide processors. Also, to maintain the tight clearance of the nips, it is desirable to provide the top rollers at a heavier weight than the bottom rollers to provide increased down force.

Figure 8:
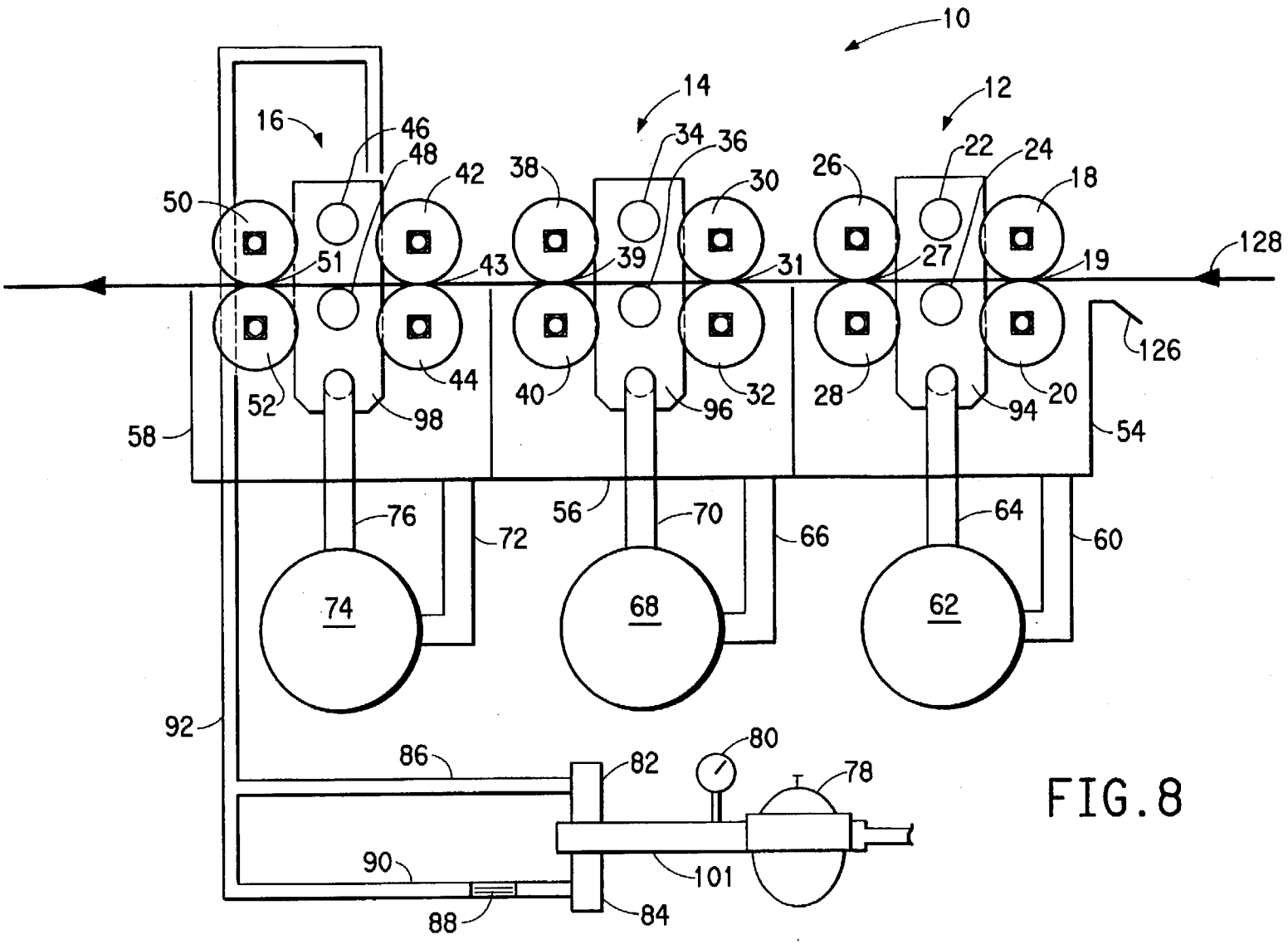
FIG. 8 is a schematic cross-sectional side view of an alternate embodiment of the wash unit.

FIG. 8 depicts an alternate embodiment wherein the nips 19,27,31,39,43,51 are all at the same level so that the sheet would not be transported at an angle. In this embodiment, the rollers 18,20,26,28,30,32,38, 40,42,44,50,52 would be made from a material that would be effective for a squeegee effect, such as, soft rubber and the like.

The sheet exits the wash unit 10 to two pairs of squeegee rollers 11,13 and 15,17 and then to a dryer 21 as depicted in FIG. 1. A series of rollers 23 transports the sheet through the dryer 21 and out of the apparatus 1.

In operation, photographic material is processed in apparatus 1 by developing in the developer station 2, fixing in fixer station 4, and washing in the wash unit 10. The process of washing the photosensitive material, comprises transporting the material through the plurality of wash stations 12,14,16 by feeding the sheet at an angle through, for example the nip 19 of the first pair of rollers 18,20, of the wash station 12 with the nip 19 positioned at a first level. In wash station 12 the next step is spraying washing solution on the top surface of the sheet from a first spray bar 22 with the washing solution draining into the container 54. There is also a step for spraying washing solution on the bottom surface of the sheet from the second spray bar 24 with the washing solution draining into the container 54. After spraying, there is a step for feeding the sheet at an angle through the nip 27 of the second pair of rollers 26,28, the nip positioned at a second level lower than the first level of the nip 19 of the first pair of rollers 18,20. The sheet is then fed to an adjacent wash station which if there are only two wash stations is the last station or to a non-wash station. Using wash station 12 as an example, in this application the adjacent wash station would be wash station 14. The steps noted above would be essentially the same for wash stations 14 and 16, except that in the case of wash station 16 as the last wash station, the feeding step after spraying would feed the sheet to the non-wash station. The non-wash station would be the first pair of squeegee rollers 11,13. The feeding steps of the sheet as noted above prevent the sheet from entering the washing solution in the containers 54,56,58.

The washing of the sheet is accomplished by the action of the spray of water from spray bars 22,24,34,36,46,48. The washing of the top surface of sheet is further accomplished wherein the water flows down the top surface into a puddle adjacent the nips 27,39,51 of the second pair of rollers 26,28,38,40,50,52 at each wash station 12,14,16. The water then flows over distal edges of the sheet and into the containers 54,56,58. This flow of the water down the top surface of the sheet and the puddling are accomplished because the sheet is transported at an incline (i.e., at an angle relative to the horizontal) which results from the nips, 19,31,43 of the first set of rollers 18,20,30,32,42,44 being at different levels from the nips 27,39,51 of the second set of rollers 26,28,38,40,50,52, respectively. Also, washing of the bottom surface of the sheet is further accomplished as the water flows down the bottom surface due to the angle of transport of the sheet, however there is no puddling effect as occurs when washing the top surface. There is also another difference in the washing of the top and bottom surfaces. To increase the efficiency of the spray from the bottom spray bars they typically have larger holes. The relatively smaller holes in the top spray bars are selected to prevent excess puddling at the nips which would detract from the washing action.

The respective difference of the levels of the nips 19,27, 31,39,43,51 within and between each of the wash stations 12,14,16 results in the sheet always being transported on an incline, which causes the water sprayed onto the surfaces of the sheet to flow down the surfaces and provide increased washing action. The positioning of the nips 19,27,31,39,43, 51 at alternately different levels so that the sheet is transported at an angle represents the preferred embodiment. However, the invention can be practiced with the sheet being transported through the wash stations not at an angle by having the nips 19,27,31,39,43,51 positioned all at the same level as depicted in FIG. 8. In either embodiment the sheet is prevented from entering the water because the rotating means transports the sheet above the specified levels of the water in the containers 54,56,58.

By transporting the sheet on an incline, there is virtually no carry-over of contaminated water from wash stations that wash the sheet when it has more chemicals on the surfaces to those wash stations that wash the sheet when it has less chemicals on the surfaces. This is because virtually all of the water sprayed on the surfaces of the sheet at each station flows back into the respective container of that station. In proceeding from one station to the next, the water in the respective containers becomes increasingly cleaner as the sheet being transported becomes increasingly cleaner due to the washing action. For example, the wash water in container 54 would be expected to be the most contaminated (i.e., "dirtiest") relative to the wash water in containers 56 and 58 because the sheet has more chemicals on its surface from the developing and fixing processes when it first enters the wash station 12. The incline of the sheet causes the water that flows from the sheet in the wash station 12 to drain into container 54 and prevents this "dirty" water from being carried over into the wash station 14. Similarly, the water that flows off the sheet and into the container 56 of the wash station 14 is "cleaner" than the water in container 54 but not as "clean" as the water in container 58 and the incline prevents carryover of this water into wash station 16. The incline acts to keep the water that flows from the sheet in the wash station 16 confined to container 58 and prevents this "cleaner" water (relative to the water in the container 56) from being carried over to the non-wash station, the pairs of squeegee rollers 11,13 and 15,17. As such, the need for wipers, seals and other such devices typically used to prevent carry-over of "dirty" wash water from one container to another is eliminated.

In the embodiment where the sheet is not transported at an angle, in addition to transporting the sheet, the rollers 18,20,26,28,30,32,38,40,42 44,50,52 would also act as squeegee rollers to prevent carry-over of "dirty" water from one container to another.

As stated above, the sheet does not enter the water in containers 54,56,58, i.e., it is not dipped or dunked or otherwise immersed into the water in the containers 54,56, 58. Because the sheet is washed without such dipping or dunking into the water, the washing can be accomplished faster than with a conventional washing unit. The rotating means transports the sheet at a rate so that a point on the sheet travels between the first pair of rollers 18,20,30,32, 42,44 and the second pair of rollers 26,28,38,40,50,52 within each of the wash stations 12,14,16, respectively, in less than three seconds. In a conventional apparatus, the sheet would typically be in a wash unit for about 30 seconds.

Another advantage of this invention is a significantly reduced usage of water. This invention uses only about 50 gallons (189.2 liters) of water per year, whereas conventional washing units use about 50,000 gallons (189,250 liters) of water per year. This low water usage is the result of the re-use of the wash water in containers 54,56,58 and the low replenishment rate of less than 20 milliliters per square foot (215 milliliters per square meter) of material being processed. The wash water is recirculated when the water from the spray bars 22,24,34,36,46,48 flows off the sheet and collects in the containers 54,56,58 and then flows to the pumps 62,68,74 through the outlets 60,66,72 for reuse.

Yet another advantage of the invention is that the wash water is not discarded into a public sewer system. The counter current flow provides for the wash water to ultimately flow from the container 54 into the fixer tank 8. The weirs 134,136 as depicted in FIG. 6 are provided within the containers 56, 58 to direct the counter current flow. Also, the weir 134 and the weir 136 are offset relative to each other. This offset provides for an appropriate residence time of the wash water in the containers 56,58. The container 54 does not have a weir, therefore the wash water flows over the lip 126. This prevents localized concentration of the wash water in the fixer process solution as it flows into the fixer tank 8 from the container 54.

Because no wash water is disposed of into the sewer system, the wash water can be either treated or recycled along with the fixer solution. This is particularly helpful when the fixer solution is treated to recover silver, because the wash water typically contains silver and the silver recovery can be increased when the wash water is mixed with the fixer solution.

Another advantage stemming from the low water usage is that there is no need as in conventional washing units to heat the wash water. Because fixer tanks are typically operated at elevated temperatures, the proximity of the container 54 to the fixer tank 8 provides heat to the wash water of container 54. Similarly, the proximity of the container 58 to the dryer 21 also provides a source of heat to the wash water. These outside heat sources, together with the very low replenishment rate of less than 20 milliliters per square foot (215 milliliters per square meter) which does not produce any significant chilling effect, provide sufficient heat to avoid the necessity of heating the wash water. This translates to significant energy savings with this invention.

The single wash unit 10 can be substituted for a higher wash solution output wash system of an existing photographic material processor. The wash unit 10 can easily be substituted by either installing as a retrofit to an existing processor or including as a component of a new processor. This is depicted in FIG. 1 where the wash unit 10 is shown occupying an area in the apparatus 1 where normally would have been a high output wash system for washing developed and fixed photographic material by conventional immersion methods. An example of a photographic material processor that could have the wash unit 10 incorporated into it would be a 37C Mark II sold by E. I. du Pont de Nemours and Company (Wilmington, Del.) and made by Glunz and Jensen (Denmark).

It is known that incomplete washing of the film after developing and fixing may cause staining, however, film washed using this invention has consistently been of archival quality.

Those skilled in the art, having the benefit of the teachings of the present invention as set forth above, can effect numerous modifications thereto. These modifications are to be construed as being encompassed within the scope of the present invention as set forth in the appended claims.

What is claimed is:

1. A process for washing a photosensitive material, comprising:

transporting the material through a plurality of wash stations including a first and a last station, and at each of the wash stations, 1) feeding the sheet at an angle through a nip of a first pair of rollers, the nip positioned at a first level, 2) spraying washing solution on a top surface of the sheet from a first spray bar and the washing solution draining into a container for receiving the washing solution, 3) spraying washing solution on a bottom surface of the sheet from a second spray bar and the washing solution draining into the container for receiving the washing solution, and 4) feeding the sheet at an angle through a nip of a second pair of rollers, the nip positioned at a second level lower than the first level of the nip of the first pair of rollers to an adjacent wash station which if there are only two wash stations is the last station or to a non-wash station;

wherein steps 1) and 4) prevent the sheet from entering the washing solution in the container for receiving washing solution from the first and second spray bars.

2. The process according to claim 1, further comprising supplying replenishment wash solution to the last container at a rate less than 20 milliliters per square foot of material being processed.

3. The process according to claim 1, further comprising transporting the sheet at a speed such that a point on the sheet travels between the first pair of rollers and the second pair of rollers in each of the wash stations in less than 3 seconds.

4. A process for washing a photosensitive material, comprising:

transporting the material through a plurality of wash stations including a first and a last station, and at each of the wash stations, 1) feeding the sheet through a nip of a first pair of rollers, the nip positioned at a first level, 2) spraying washing solution on a top surface of the sheet from a first spray bar and the washing solution draining into a container for receiving the washing solution, 3) spraying washing solution on a bottom surface of the sheet from a second spray bar and the washing solution draining into the container for receiving the washing solution, and 4) feeding the sheet through a nip of a second pair of rollers, the nip positioned at the same level as the first level of the nip of the first pair of rollers to an adjacent wash station which if there are only two wash stations is the last station or to a non-wash station;

wherein steps 1) and 4) prevent the sheet from entering the washing solution in the container for receiving washing solution from the first and second spray bars.

* * * * *